US005832982A

United States Patent [19]

Williams et al.

[11] Patent Number: 5,832,982

[45] Date of Patent: Nov. 10, 1998

[54] METAL FORMING PROCESS

[75] Inventors: Samuel B. Williams, Bloomfield Hills; Timothy A. Nielsen, Walled Lake; James S. Prosser, Fenton; William P. Schimmel, Milford, all of Mich.

[73] Assignee: Williams International Co., L.L.C., Walled Lake, Mich.

[21] Appl. No.: 789,647

[22] Filed: Jan. 29, 1997

[51] Int. Cl.[6] ..... B22D 17/14

[52] U.S. Cl. ..... 164/61; 164/113; 164/900

[58] Field of Search ..... 164/900, 312, 164/113, 61

[56] References Cited

U.S. PATENT DOCUMENTS

| | | | |
|---|---|---|---|
| 3,596,708 | 8/1971 | Lapin | 164/312 |
| 4,510,987 | 4/1985 | Collot | 164/900 |
| 5,299,619 | 4/1994 | Chandley et al. | 164/53 |
| 5,564,492 | 10/1996 | Preiss | 164/516 |
| 5,570,502 | 11/1996 | Sawtell et al. | 164/97 |
| 5,638,889 | 6/1997 | Sugiura et al. | 164/312 |
| 5,657,833 | 8/1997 | Freeman | 164/267 |

FOREIGN PATENT DOCUMENTS

| | | | |
|---|---|---|---|
| 2-59160 | 2/1990 | Japan | 164/312 |
| 3-13259 | 1/1991 | Japan | 164/900 |

OTHER PUBLICATIONS

"Thixoforging–semi–solid metal forming route for near–net–shaping", Metallurgia, D. Kirkwood and M. Sellars, Jun. 1991, V.58, p. S10.

"Injection Molding of Magnesium Alloys", Chemical & Engineering News, Ward Worthy, Jun. 1988, V.66, pp. 29, 30.

"One–step Process Simplifies Magnesium Injection–Molding", Design News, E. J. Stefanides, Nov. 1988, V.44, pp. 108, 109.

"Mag: Thixotropic casting going commercial", Modern Metals, J. Neiland Pennington, Jun. 1992, V.48, pp. 30–44.

"Injection Molding Magnesium Alloys", Advanced Materials & Processes inc. Metal Progress, P. Frederick, N. Bradley and S. Erickson, Oct. 1988, V.134, pp. 53–56.

*Primary Examiner*—Kuang Y. Lin
*Attorney, Agent, or Firm*—Lyon, P.C.

[57] ABSTRACT

Methods for semisolid manufacturing of precision parts, turbine rotors for example, comprised of high melting point alloys are given. Generally, a semisolid/thixotropic process is operated under vacuum utilizing a removable mold. The process preferably comprises a vacuum chamber, an inductive heater to bring a high melting point alloy to a thixotropic phase, a supercooled mold comprised of a low melting point alloy or metal, and a plunger that accelerates and injects the high melting point alloy into the low melting point mold. As the formed part cools, the supercooled low melting point mold heats up to its melting point upon which separation from the formed part occurs. Supercooling of the removable mold permits the use of thixotropic methods for high melting point alloys.

4 Claims, 2 Drawing Sheets

10

METAL FORMING PROCESS

BACKGROUND OF THE INVENTION

The present invention relates to a method of forming precision metal parts and, more specifically, to thixotropic forming of precision metal parts.

As performance criteria for turbine engines becomes more stringent, there is a need for an improved turbine rotor that exhibits maximum resistance to both fatigue and creep.

Die casting is a well-known process for producing complex components with excellent surface quality and good dimensional accuracy. However, the structural integrity of die castings is often compromised by air trapped in the casting upon injection of the liquid metal into the die casting cavity. The resultant porosity also compromises heat treatment of the casting which is often necessary to refine the grain structure and increase the strength of the casting.

Forging is also a well known process for producing relatively strong components having a desirable grain structure. However, forged products generally exhibit relatively low resistance to creep.

Thixotropic, or semisolid, metal forming is a viable alternative to traditional casting and forging methods. This process lies somewhere between a casting and a forging process in that the slug of metal to be formed will be brought to a "thixotropic" phase; that is, 30 or 40 percent of the mass will be in a liquid phase and the balance is a solid state. The solid portion comprises small spherically-shaped nodules suspended within the liquid phase. Semisolid metals heated to a thixotropic phase exhibit unique rheological properties due to their non-dendritic, or spherical, microstructure. The rheological properties of the semisolid metal range from high viscosities, like table butter, for alloys at rest, to low viscosities, such as machine oil, as the shearing rate of the semisolid slug is increased. By heating the metals to a semisolid range and then agitating the semisolid alloy, the dendritic microstructure normally found is eliminated and replaced by the spherical microstructure. Upon solidification, the alloys then exhibit a fine equiaxed microstructure.

Normally, a highly viscous thixotropic slug will retain its outer shape provided there are no external forces, other than gravity, applied to it. However, its butter-like consistency is easily deformed to a low viscosity, particularly by a shearing action such as high velocity impact, making it extremely suitable when driving the alloy into the mold during the manufacturing process. Because semisolid-formed alloys exhibit an intermediate-sized grain structure, larger than forged grains and smaller than cast grains, it is expected that semisolid forged or cast alloys will have improved creep rupture resistance over traditionally forged alloys and improved strength properties over traditionally cast alloys.

The thixotropic process has been extensively studied by others in relation to lighter metals such as aluminum, magnesium, zinc, and copper alloys. However, very little research has occurred with regard to high temperature alloys commonly used in turbine rotors, including ferrous or nickel-based alloys. One significant difference between semisolid production for lighter alloys and that for high temperature alloys involves the adaptation of the process to the problematic and high heating temperatures of 2500° F. to 2700° F. as opposed to alloys in the 1200° F. melting point range. Designing a semisolid process compatible with such high heat has proven challenging. Generally, chrome-nickel alloys of, for example, 18% Cr and 82% Ni are used in turbine rotor forgings. This alloy has a solidus of 2550° F., and a liquidus of 2640° F. where the alloy is completely molten. The semisolid/thixotropic phase exists between the solidus and liquidus temperatures at temperatures ranging between 2550° F. and 2640° F. The alloy is commonly forged at temperatures below 2550° F., in the solid phase, and cast at molten temperatures above 2640° F., in the liquid phase.

Yet another problem that must be addressed is that current forging and casting equipment design includes permanent molds that often do not readily separate from the part interface when removing the turbine rotors and their intricate blades from the mold. This results in fractured or weakened blades and a corresponding number of rejected parts that do not meet design specifications. A need exists for semisolid manufacturing methods that facilitate ease of removal of the finished part, thereby improving the production volume and reducing the rejection rate of the finished parts.

SUMMARY OF THE INVENTION

The present invention solves the aforementioned problems by implementing a thixotropic process for the production of turbine rotors and other parts of intricate design that comprise high melting point alloys. Unlike common manufacturing methods wherein a permanent mold or die is utilized, a removable and/or replaceable die is employed that is supercooled at an initial stage of the process thereby facilitating semisolid manufacturing. Several embodiments of the process are envisioned.

A slug of high temperature alloy is first machined to the approximate shape of the disc portion of the turbine with additional stock left on the back side of the disc shape. The additional stock is of a magnitude to more than fill the turbine blade cavities between the die segments when the slug is forced into the cavity. The slug is then heated to a thixotropic state and then subsequently injected into a die. The entire manufacturing process is conducted in a vacuum chamber to prevent oxidation of the high temperature alloy and to avoid the formation of air pockets when the slug is forced into the die at high velocity.

One process employs the use of a low melting point alloy as the die or mold. The mold is supercooled by way of a surrounding cooling jacket immediately prior to accelerated injection of the thixotropic high melting point alloy into an open-faced low melting point mold. Heat generated during the manufacturing process is transferred to the mold, comprised of the low melting point alloy, thereby increasing the temperature of the mold and reducing the temperature of the high melting point alloy. The thixotropic alloy solidifies as it cools, and concurrently, the mold attains a temperature sufficiently elevated to melt it away from the finished part.

Another embodiment has particular utility for manufacturing a radial inflow turbine. A segmented die is used comprising individual segments. The segments are preferably divided in half and inserted and extracted in a radial direction. Twisting may be required as the die segments are moved into or out of position. When in position, the segments form the cavity or mold for forming all but the back side of the finished turbine part. Once in a thixotropic state, accelerated injection of the slug creates shear forces that cause a very low equivalent viscosity so that the blade spaces of the die fill completely.

The die segments are then moved out of position using large, individual, high strength solenoids. Electrical actuators are employed because of the vacuum environment which is hard to maintain with hydraulic or air pressure actuation. High speed actuators are employed to extract the die segments since the intent is to leave the high temperature slug in contact with the die only for an instant to prevent overheating of the die segments. Even with very short-term contact between the hot high temperature alloy and the die segments, the temperature of the alloy surface that is in intimate contact with the die drops extremely rapidly, ensuring that the shape of the part is held as the segments are extracted.

Modified equipment design may be utilized in alternate embodiments of the high melting point alloy semisolid process.

DETAILED DESCRIPTION OF THE PREFERRED EMBODIMENT(S)

Figure 1:
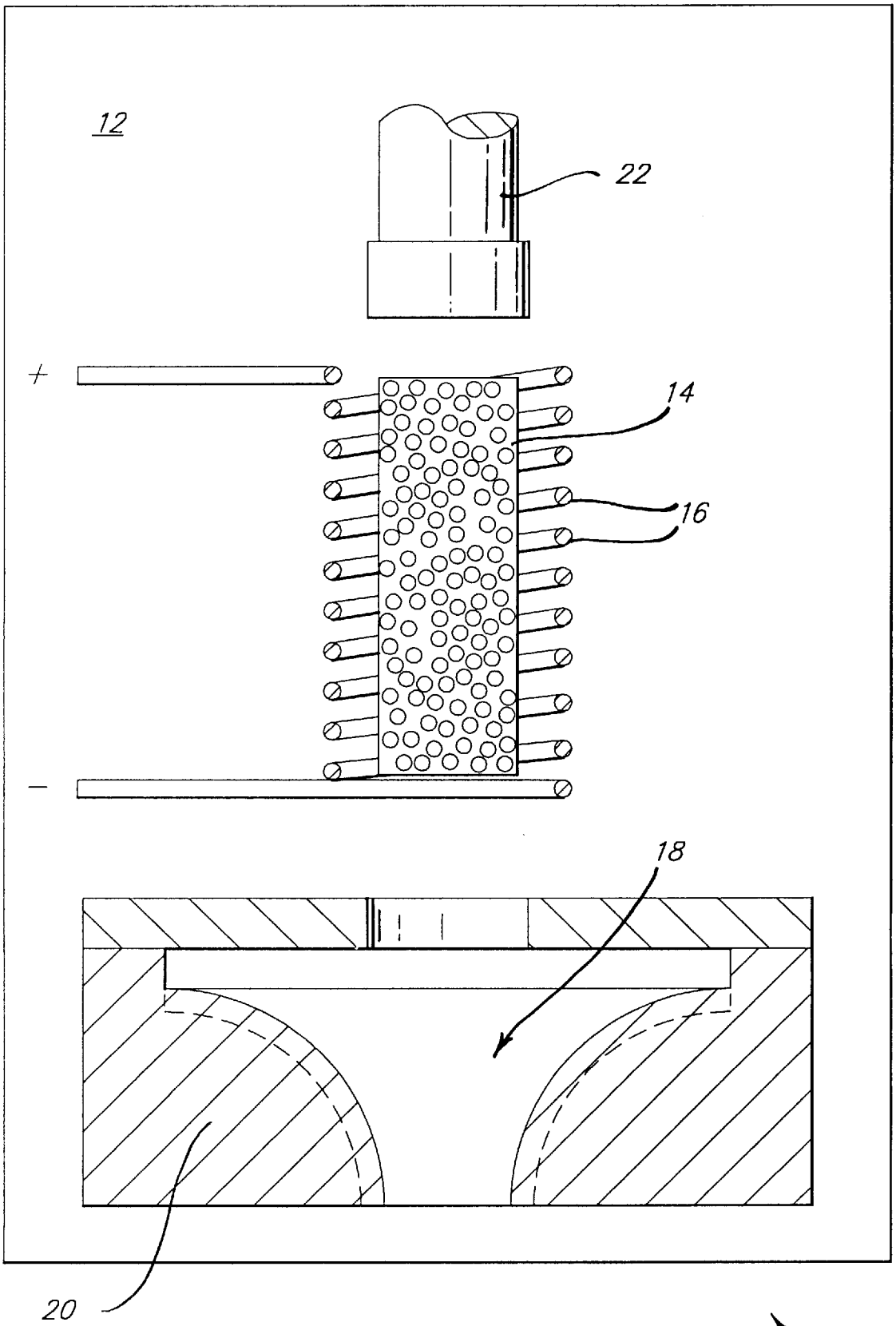
FIG. 1 illustrates the thixotropic process during the heating stage of the high temperature alloy.
Figure 2:
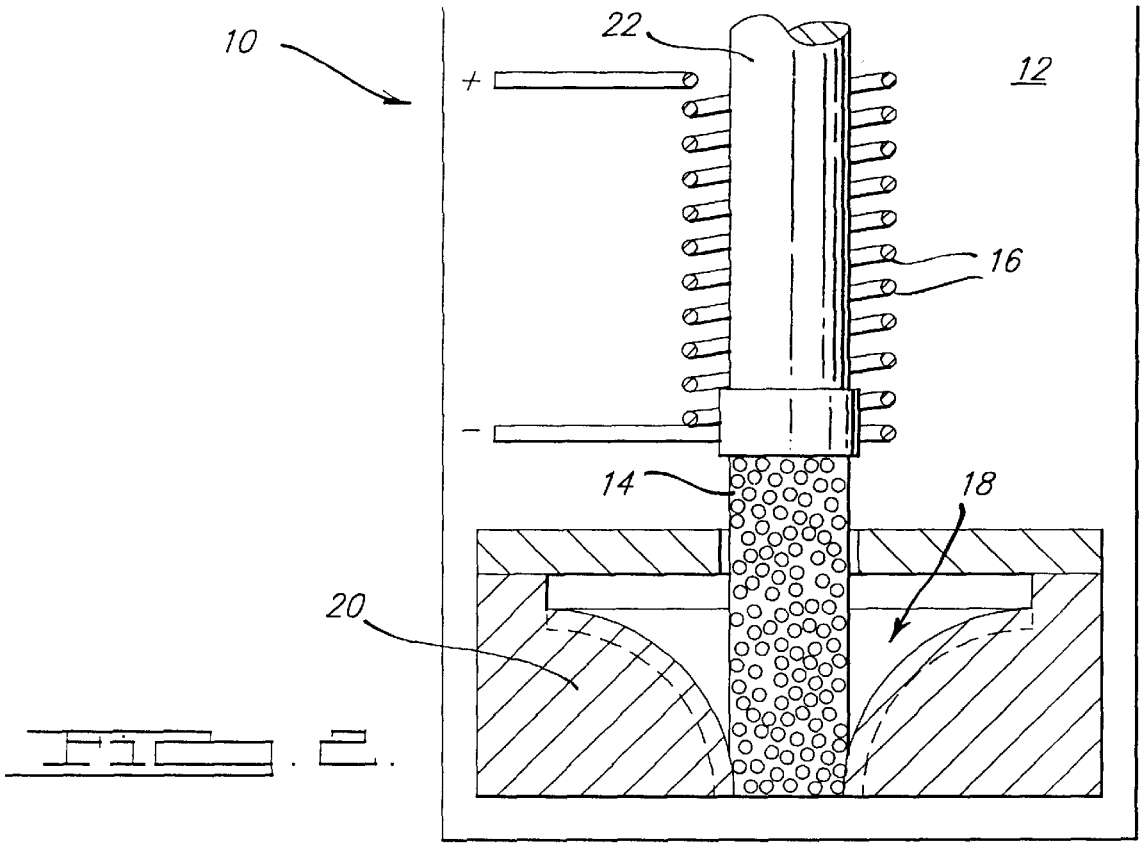
FIG. 2 illustrates the acceleration and injection of the high temperature alloy.
Figure 3:
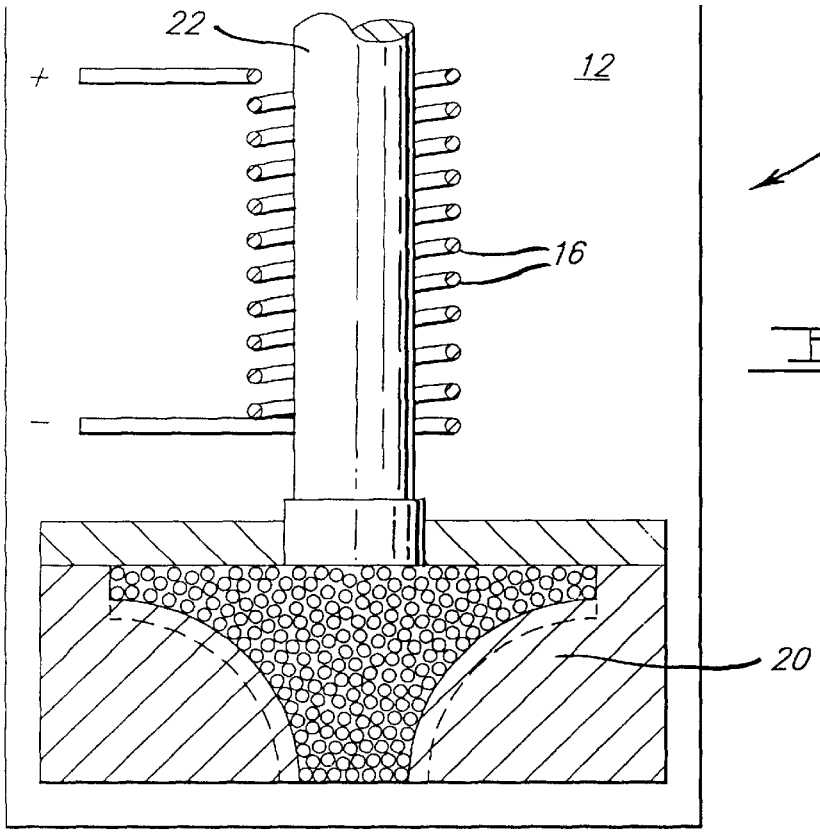
FIG. 3 illustrates the thixotropic process during the forming and solidification of the high temperature alloy.

In accordance with the present invention, a semisolid forging/casting process 10 is illustrated in the drawings, as it exists within a vacuum chamber 12. In accordance with a preferred embodiment of the present invention, an electrical inductive heater and tube 14 is located at upper and middle sections of the chamber 12. Induction heat elements 16 line the tube 14 generating a uniform heat throughout the uncooled portion of the vacuum chamber 12. Because the metal alloy slug must attain a semisolid state, the induction heater serves to heat and electrically "stir" the alloy thereby causing a shearing action and creating a thixotropic phase.

A removable mold 18 is located at the lower end of the vacuum chamber 12. The mold 18 should either be completely removable or comprise segments that can be retracted, electrically for example, upon solidification of the molded part. In the preferred embodiment, the mold 18 consists of a low melting point-alloy comprised of metals such as lead or zinc, that when exposed to high heat is designed to melt away from the high temperature alloy and provide a finished part.

The turbine blade portions of the mold are downwardly and bottomly positioned in the mold wherein the upper part of the mold is open-faced thereby allowing injection of the thixotropic alloy. A cooling jacket 20 surrounds and supercools the mold 18. The mold 18 may be cooled by various means such as, for example, water cooling passages, cold air blasts, or sub-zero $CO_2$ blasts within the cooling jacket 20. A plunger 22 is located at the upper end of the vacuum chamber 12 and is actuated by pneumatic, electrical, hydraulic, mechanical or other means.

Before implementing the process, the slug of high temperature alloy should first be machined to the approximate shape of the disc portion of the turbine with additional stock left on the back side of the disc shape. The excess stock should be great enough to more than fill the turbine blade cavities between the die segments when the slug is forced into the cavity.

In operation, the entire manufacturing process is conducted in a vacuum chamber to eliminate oxidation of the high temperature alloy and furthermore, to avoid formation of air pockets as the slug is accelerated into the die cavity. By decreasing the air pockets, porosity is decreased thereby permitting heat treatment and strengthening of the finished product.

Initially, the high melting point slug is inserted into the heater 14 and beneath the plunger 22. Once the inductively heated alloy has attained a thixotropic phase, the low melting point die 18 is supercooled by the jacket 20 to a reduced temperature of approximately −100° F. As discussed below, mold design may vary and depending on its design, the mold 18 may be supercooled in an approximate range of −100° F. for low melting point alloy molds, to 2000° F. for high melting point alloy molds. The cooling of the low melting point die increases its hardness and permits slug extrusion into the mold cavities without erosion of the mold's surface, despite the high velocity of the slug. Immediately thereafter, the plunger 22 forcefully accelerates and injects the thixotropic solution into the open-faced die 18. The plunger 22 and the heater 14 may also be positioned below the die 18 wherein the high melting point slug is then upwardly accelerated into the inversely positioned die 18, thereby providing added control over the acceleration of the alloy.

When the slug is forced at high velocity into the die cavities, the shear forces create a very low equivalent viscosity of the slug. The low viscosity ensures complete filling of the die even though the blade cavities within the die are very thin.

Once the slug is injected into the mold, and the heat from the process continues to pass from the high temperature rotor material to the low temperature mold, the temperature of the mold approaches the melting point of the mold composition. Upon reaching its melting point, the mold falls away and is separated from the high temperature alloy.

By cooling the rotor material, the thixotropic or semisolid phase is eliminated. The solidified alloy now possesses the properties advantageous in both the forging and casting processes such as high creep resistance, high strength, and low fatigue, and yet exhibits less shrinkage and gas porosity than castings. Furthermore, the process enhances rapid production rates and net shape fabrication.

Several features of the preferred method presented may be altered in various ways. For example, in lieu of a plunger 22, the acceleration step might include an electrical cannon or linear acceleration through an electric field as a method of driving the thixotropic rotor material into the mold 18. Alternatively, a vertical transfer tube extending from the upper induction heater 14 and down to the bottom mold 18 provides a gravitational means of acceleration. The vacuum chamber may incorporate a long vertical tube from 20 to 80 feet in height, having the inductive heater 14 at an upper end and inductive heating elements 16 lining the length of the vertical tube, thereby ensuring homogeneous heating throughout the tube. The thixotropic slug is then dropped accelerating to high velocity before impacting into the open face of the die. When the tapered disc shape of the slug impacts the die 18, the metal is extruded into turbine blade cavities within the die 18. This shearing action takes place at high velocity with the flow being equivalent to that of a low viscosity fluid. Once the shearing action stops, the viscosity increases and the part tends to hold its new shape. The surfaces in contact with the die cool rapidly to further retain shape integrity. As soon as the die is filled, the metal is trapped within because of the geometry of the blade shapes. As such, the metal will not tend to bounce upwardly and out of the die. The area of the vacuum chamber surrounding the die is kept at a very low temperature to ensure quick cooling before the next cycle.

The heat may also be applied in a variety of ways. Although the preferred embodiment utilizes an induction heater imparting a heating, stirring and shearing action to the high temperature rotor material, other heating methods include electrical resistive heating that would be incorporated in combination with alternate shearing methods such as tapered ramming of the slug. For example, the plunger used could be conically shaped and correspond to a conically shaped gate through which the slug would pass through as accelerated into the mold. As the slug passed from a larger diameter at an upper end of the gate to a smaller diameter at a lower end of the gate, compaction of the slug would provide the necessary shearing action. The heating and shearing parameters are critical in forming the thixotropic phase thereby preventing formation of the usual resultant dendritic microstructure and promoting a desirable nondendritic microstructure.

Finally, the solidification and forming step may utilize a mold 18 comprising high melting point alloy segments or half-segments that may be electrically and radially retracted upon solidification of the molded part. The mold segments may also be retracted by other means including pneumatic or hydraulic force, but segment removal by electric actuation through high strength solenoids, for example, is preferred thereby ensuring vacuum integrity. The extraction should be high in velocity, leaving the high temperature slug in contact with the die 18 only for an instant to prevent overheating of the die segments. The die is supercooled to maintain a temperature no greater than 2000° F. Even with very short-term contact between the hot high temperature alloy and the die segments, the high temperature alloy surface that is in intimate contact with the supercooled die will drop in temperature extremely rapidly, such that the designed shape of the part is maintained as the segments are extracted. Continuous supercooling of the mold before, during, and after injection of the slug provides rapid cooling, rapid part removal, and rapid cycling and improved production rates. Once the part is removed, the segments are automatically reinserted in preparation for the next production cycle.

In addition, the mold may alternatively consist of disposable precision injected molded plastic, supercooled just prior to injection, that would not require actuation means but would require separation of the disposable plastic mold from the solidified alloy once the combined finished part and mold had been removed from the process and cooled.

Depending on designed properties of the finished part, the thixotropic process may comprise various solid/liquid percentages by adjustments in thermal processing. In other words, the temperature may be increased or decreased within the semisolid temperature range resulting in more or less of a liquid interphase, and variations in the final grain structure. This provides design flexibility and variability of the blade and bore properties of the rotor, thereby resulting in an optimum combination of mechanical properties tailored for specific applications.

While the preferred embodiment of the invention has been disclosed, it should be appreciated that the invention is susceptible of modification without departing from the scope of the following claims.

We claim:

1. A thixotropic method of forming an intricate high melting point metal part comprising the steps of:

inserting a slug of high melting point metal within a transfer tube at a first end of a vacuum chamber;

creating a vacuum within said vacuum chamber;

inductively heating the first end and the transfer tube of said vacuum chamber to a predetermined temperature thereby forming a semisolid or thixotropic solution within said slug comprising 60–70% solids;

supercooling a removable die located at a second end of said vacuum chamber, wherein said removable die is formed from a material selected from the group consisting of lead, tin, zinc, and alloys thereof;

accelerating the semisolid solution from the first end of said vacuum chamber, through said heated transfer tube and into said supercooled removable die;

cooling the semisolid solution within said removable die thereby solidifying the high temperature metal therein; and removing said die and the solidified high melting point metal part from the process.

2. The method of claim 1 wherein said removal step comprises allowing said die to melt and fall free from the solidified high melting point metal part.

3. A thixotropic method of forming an intricate high melting point metal part comprising the steps of:

inserting a slug of high melting point metal within a transfer tube at a first end of a vacuum chamber;

creating a vacuum within said vacuum chamber;

heating the first end and the transfer tube of said vacuum chamber, thereby forming a semisolid solution within said slug;

supercooling a removable die located at a second end of said vacuum chamber, wherein said removable die is formed from precision injected molded plastic;

accelerating the semisolid solution from the first end of said vacuum chamber, through said heated transfer tube and into said supercooled removable die;

cooling the semisolid solution within said removable die thereby solidifying the high temperature metal therein;

removing said die and the attached solidified high melting point metal part, as a unit, from said vacuum chamber;

cooling the unit; and separating said die from the solidified metal part.

4. A thixotropic method of forming an intricate high melting point metal part comprising the steps of:

inserting a slug of high melting point metal within a transfer tube at a first end of a vacuum chamber;

creating a vacuum within said vacuum chamber;

heating the first end and the transfer tube of said vacuum chamber, thereby forming a semisolid solution within said slug;

supercooling a removable die located at a second end of said vacuum chamber, wherein said removable die is formed from a material selected from the group consisting of lead, tin, zinc, and alloys thereof;

accelerating the semisolid solution from the first end of said vacuum chamber, through said heated transfer tube and into said supercooled removable die;

cooling the semisolid solution within said removable die thereby solidifying the high temperature metal therein; and removing said die and the solidified high melting point metal part from the process, wherein the low melting point die is removed by allowing the die to melt and fall free from the high melting point solidified metal part.

* * * * *